United States Patent [19]

Nauta

[11] Patent Number: 4,887,752

[45] Date of Patent: Dec. 19, 1989

[54] SELF-LOCKING TRANSPORT STRAP

[76] Inventor: Adriaen E. R. Nauta, 101B Josephstreet, 3002 EE Rotterdam, Netherlands

[21] Appl. No.: 598,347

[22] PCT Filed: Jul. 19, 1983

[86] PCT No.: PCT/EP83/00191

§ 371 Date: Mar. 15, 1984

§ 102(e) Date: Mar. 15, 1984

[87] PCT Pub. No.: WO84/00286

PCT Pub. Date: Feb. 2, 1984

[51] Int. Cl.[4] ..... A45F 3/14; B63B 35/72

[52] U.S. Cl. ..... 224/202; 224/157; 224/258

[58] Field of Search ..... 224/257, 202, 205, 258, 224/157; 294/77, 74

[56] References Cited

U.S. PATENT DOCUMENTS

| | | | |
|---|---|---|---|
| 136,059 | 2/1873 | Hohorst | 294/77 |
| 794,948 | 7/1905 | Rischard | 224/257 |
| 1,824,027 | 9/1931 | Lundquist | 294/77 |
| 3,829,144 | 8/1974 | Nattrass | 294/74 |

FOREIGN PATENT DOCUMENTS

| | | | |
|---|---|---|---|
| 7735219 | 5/1978 | Fed. Rep. of Germany . | |
| 2493117 | 5/1982 | France . | |
| 533584 | 1/1940 | United Kingdom | 294/77 |

*Primary Examiner*—Henry J. Recla

*Attorney, Agent, or Firm*—Fleit, Jacobson, Cohn, Price, Holman & Stern

[57] ABSTRACT

Heavy objects may be transported by one man by means of the self-lockable transport strap. A large panel or surf-board may be transported by means of a support band which passes under the object and of which the two upper ends are connected by means of at least one belt. Each belt may be hooked to the end of a conventional strap bearing on the shoulders, the band and the belt tightening themselves on the object to be transported.

3 Claims, 3 Drawing Sheets

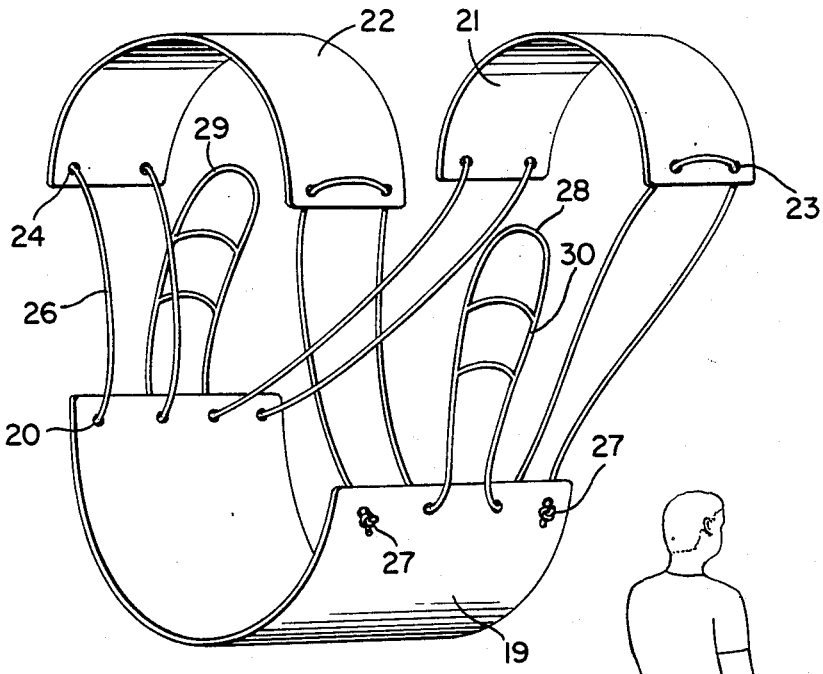
FIG. 9
FIG. 10
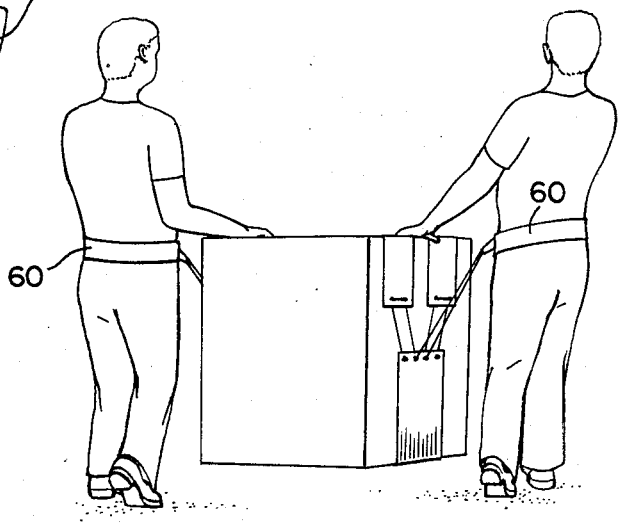
FIG. 11
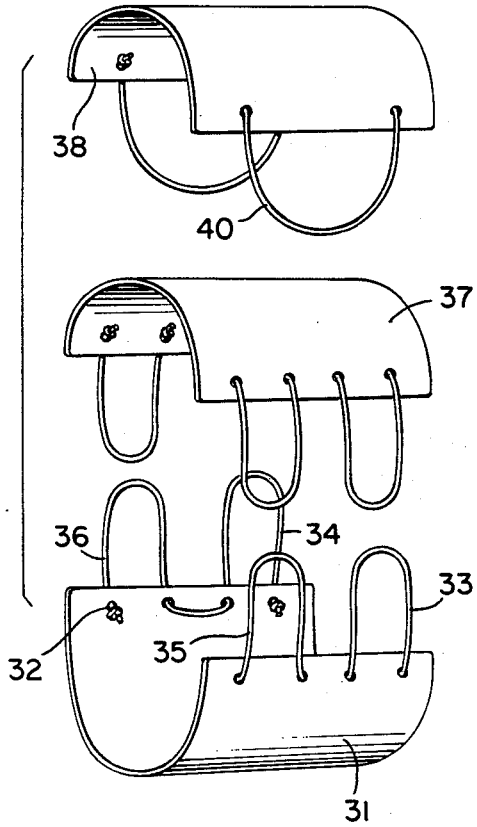
FIG. 12
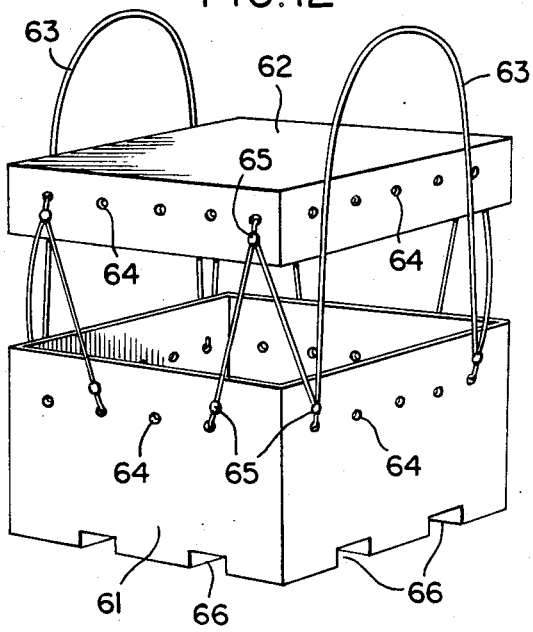

SELF-LOCKING TRANSPORT STRAP

The invention relates to a self-locking transport strap (or belt device) to carry a heavy or irregularly shaped object, e.g. a large panel, a painting, a surf-board, a closet, a case or something similar. Such an object is nearly always difficult to handle when transported by one person, because it cannot or cannot hardly be held due to the large height of the object or due to the fact that several separated pieces (packets or packages) can hardly be held together. The invention aims at providing a self-locking transport strap that enables the easy transportation of such objects, separated or packed up and the user experiences that the transport device can be applied and released very quickly and it can also be easily carried.

A self-locking transport strap according to the invention is provided with a support band that tightens itself around the lower half of the object and the upper half of the object is supported by at least one belt that is led or passed through the extremities of the support band, and after hooking each belt with its ends onto a conventional shoulder belt, the support band and the belts tighten themselves automatically around the object during transport.

In a simple embodiment of the invention, the upper half of the object is encompassed by an endless belt and at both sides, between the belt parts, is a raising belt sling to be hooked onto the shoulder belt.

The guiding elements for the belt (or band) may be constructed in several ways, e.g. by holes, inserted eyelets of metal or plastic, confectioned slings, inserted slings made of band-, belt-, or cord material, accessories made of metal or plastic with one or more passage-ways. It is advantageous to construct the support band using net-like material of which the holes at the extremities simultaneously constitute passage-ways for the belt.

In one specific embodiment the passage-way for the belt (or band) of the support band is constructed in such a way that the belt has several slings so that the encompassment capacity of the transport strap may be readjusted as well as the transport height for the person carrying the belt.

In another embodiment possible undesirable belt notches or belt marks on the object may be prevented by inserting one or more suitable intermediate parts in the belt unit at places where such marks occur. Also to protect the transport strap, one may take additional measures, e.g. for transport of glass. Most additions are associated with the nature of the object to be transported or with the transport circumstances, e.g. high tensile, elastic, rough, smooth material as well as prefabricated shape-fixed parts.

The intermediate parts of the transport strap may be of a size to encompass the object essentially, so that the belt (or band) functions to connect, possibly mutually, the intermediate parts and with them the lower part of the transport strap and furthermore to tighten these parts around the object by means of passage-ways at the lower part and possibly passage-ways at the intermediate parts, thus raising the object by means of the belt slings.

An element should be included in the support band or in the belt (or band) of the invented transport strap, in order to open, lock or interrupt the relevant part. This element can also be placed near the passage-way of the belt or be combined with the passage-way. Thereto a conventional accessory of metal or plastic (e.g. carabine hook) may be used or e.g. a fastening by means of sticking band.

The inventive idea shows also an embodiment wherein both ends of the lower support band are provided with guiding elements to pass through a second upper band, of which the ends are provided with carrying elements, handgrips or holes, to be connected with e.g. a shoulder belt at choice.

Another simple embodiment shows the transport strap consisting of a support band which is provided with a passage-way (guiding element) at one end through which the other end of the same support band is passed. Both this other end and specific parts of the support band are provided with carrying elements or the like to be hooked onto a shoulder belt. Lifting the object by way of the carrying elements of the support band results in a self-locking effect, as provided for by the invention.

The invention may also be realized in another embodiment in which the lower part is loosely connected with the upper part of the transport strap by means of belt or band slings, holes, accessories or passage-ways respectively, after which the first slings can be lifted to obtain the self locking effect.

In another embodiment the lower half of the transport strap consists of a shape-fixed or solid part with passage-ways for the belt or band in the upper part. The upper part may also consist of a solid part with passage-ways for the belt or band respectively. The belt or band that thightens the lower and upper part, solid or not, around the object, serving to lift that object, can be guided through the lower and upper part by means of passage-ways in such a manner, that the belt or band respectively cannot get loose. Measures against loosing can also be taken on the belt or band while these measures can also involve the lower and/or upper part.

The invention will be illustrated by means of the drawing various embodiments.

FIGS. 9 and 11 show an undivided and divided transport strap respectively;

FIG. 10 shows the application of the transport strap to a relatively big case;

FIG. 12 shows another embodiment of the transport strap using hooks/eyelets;

Figure 1:
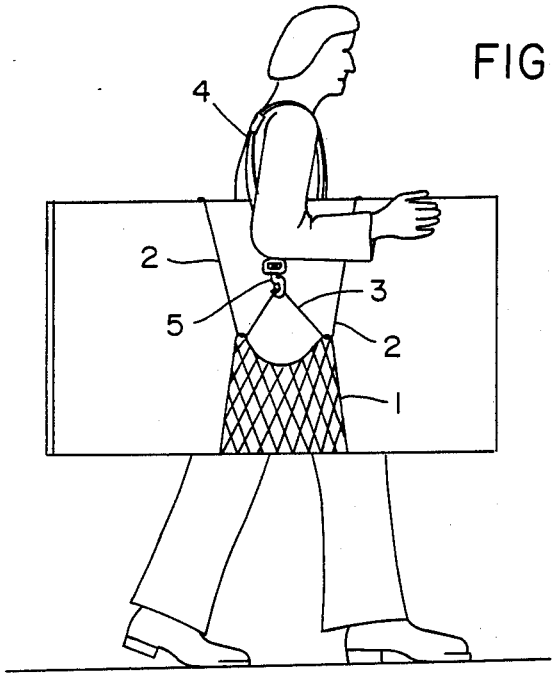
FIG. 1 shows the self-locking transport strap in its use of transporting an object that is difficult to handle.

The transport strap in FIG. 1 consists of a net-like support band 1 that is placed at both sides of the object to be transported and an endless belt 2 is guided through the upper holes of the net-like support band 1. The belt 2 passes over the top of the object and a belt sling 3 is drawn up between the upper holes on both sides, thereby raising belt.

Figure 2:
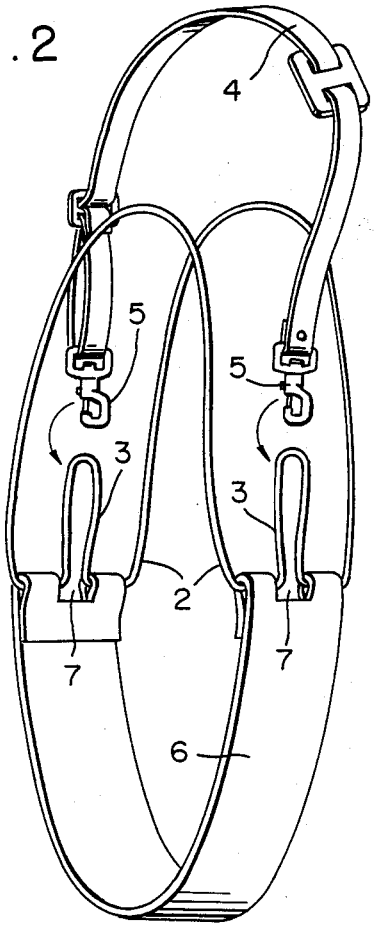
FIG. 2 shows a transport strap of a slightly different design (style)

In FIG. 2, the net-like support band is replaced by a closed belt; the guidance of the belt 2 takes place by means of hems in the band material, which is hemmed at the extremities of the band 6 in such a way that a gap 7 is formed which allows the belt sling 3 to pass through. The sling 3 is connected with a conventional linking hook 5 (carabine hook) at both ends of the conventional shoulder belt 4. In this embodiment, the passing of the belt 2 through the band material may be prevented at some places. For instance, hole 7 may only serve to allow the passing belt 2 to be connected with hook 5; the other hole allows the belt to pass through and the self-locking is obtained.

Figure 3:
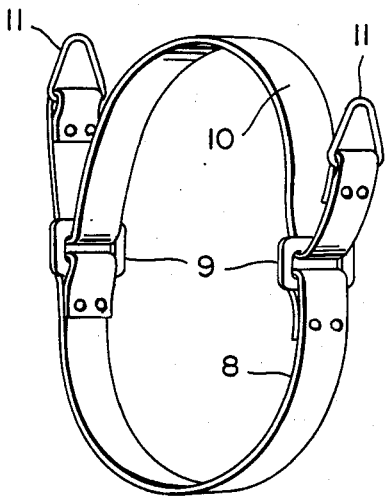
FIGS. 3 and 4 show examples of the transport strap according to the invention constructed of support bands only.
Figure 4:
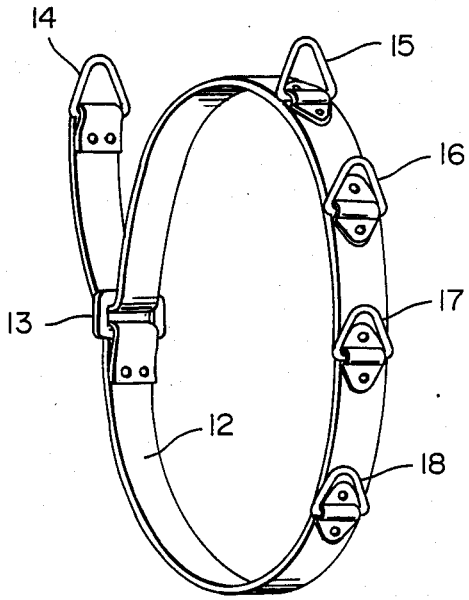

FIGS. 3 and 4 illustrate a very simple embodiment without using a belt. In FIG. 3 the support band 8 is provided with eyelets 9 at both ends to serve as a passage-way for the self-locking upper band 10 that is provided with carrying elements 11 at both ends to be connected with the linking hook 5 of the shoulder belt 4, as in FIG. 1. During transport the bands 8 and 10 tighten around the object to be transported. A further simplification of the embodiment shown in FIG. 4 consists of a continuous support band 12 that has an eyelet 13 serving as a passage-way at its one end, and a carrying element 14 at its other end. Next to this there are several carrying elements 15, 16, 17 and 18 that each can be applied to the other side of the object to be transported. That choice depends on the size of the object, while also the height with which the object is carried by a person may vary. Again, the tightening is obtained by pulling the carrying element 14 and one of the other elements 15–18.

Figure 5:
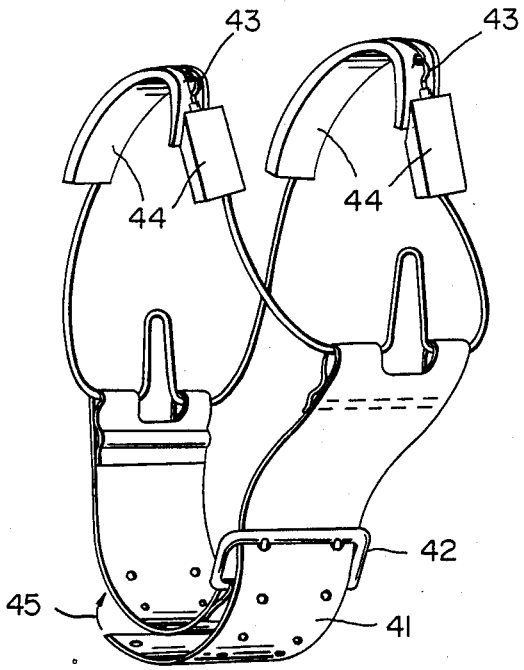
FIG. 5 shows a transport strap with a readjustable lower support band.

In FIG. 5 another embodiment of the invention is shown with accessories with regard to FIG. 2. The lower support band has been made readjustable as is usual of a belt by means of a wide buckle 42. The outcoming part 41 can be fixed by means of press buttons or sticking band 45. A fastening device 43 is constructed at the upper part and bands of protective material 44 serve to prevent marking on the objects.

Figure 6:
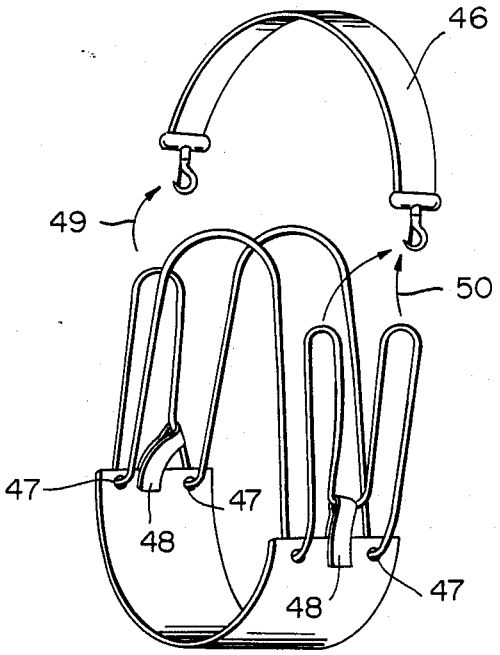
FIGS. 6 and 7 are different embodiments of the invention.

FIG. 6 shows the invented idea in which an endless belt passes through both ends of a support band by means of two eyelets 47 and a sling 48. In this way one can choose to make one sling 49 or two slings 50 at both sides of the support band. The possibilities of adjustment of the transport strap to the size of the object and the fixing of the transport height are greater than e.g. in the embodiment of FIG. 2. Hence, it is sufficient for the transport of objects by more than one person to use a non-readjustable transport band 46 onto which a sling 49 or more slings 50 may be hooked. The self-locking effect is obtained by pulling slings 49 and 50.

Figure 7:
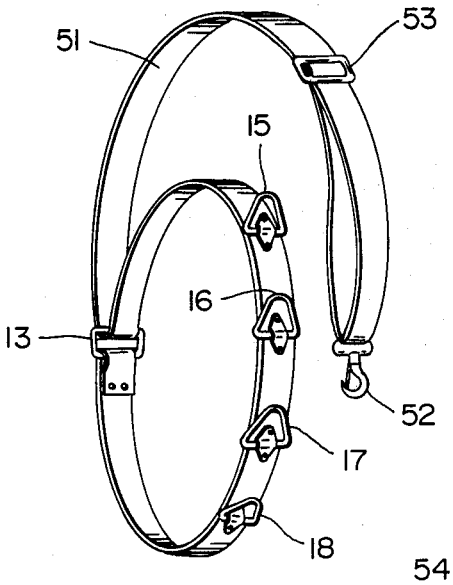

FIG. 7 shows a variant of the embodiment of FIG. 4. The difference is an extra shoulder belt 51 as a continuous band of the transport strap. An optimum amount of readjusting is obtained by readjusting the part that functions as shoulder strap by means of a buckle 53 as well as the choice to hook accessory 53 onto a carrying element 15–18.

Figure 8:
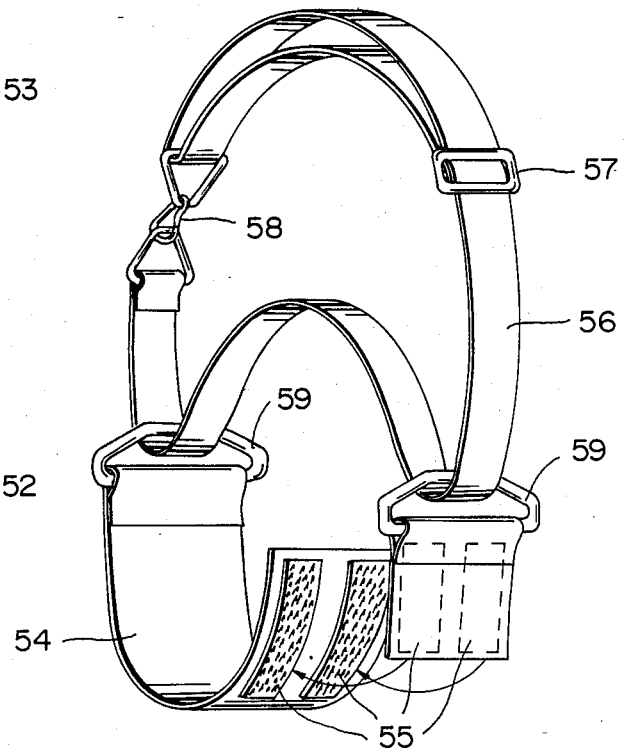
FIG. 8 shows a variant of the embodiment of FIG. 3.

FIG. 8 shows a variant of the embodiment of FIG. 3. The lower support band 54 can be opened or closed respectively near the passage-way 59 and can be made readjustable by means of sticking band 55. The upper support band constitutes a unit with a shoulder belt 59 that is readjustable by means of a buckle 57 and it may possibly be opened by accessory 58.

FIG. 9 shows another embodiment of the self-locking transport strap with a relatively wide lower support band 19 that is provided with several eyelets 20 and with two intermediate parts 21 and 22, also having eyelets 23 and 24 respectively. Two separate belts 25 and 26 connect the support band 19 with the intermediate parts 21 and 22 through the eyelets. The belt ends, as shown, can be attached to the support band by means of a knot 27 behind the eyelet, but there are other ways of attaching them to the support band 19. Belt slings 28 and 29 respectively are located in the middle part of both belts 25 and 26 to be hooked onto a hip band 60, as in FIG. 10. A specific amount of readjustment is obtained because of the fact that rings 30 are constructed over the length of the belt slings.

FIG. 10 shows the application of a transport strap according to the invention as in FIG. 9. In carrying objects, e.g. such as refrigerators, TV-sets and so on, this transport strap can be employed by more than one carrying person by using hip bands and/or shoulder bands.

FIG. 11 shows a transport strap, divided into two separate parts, a lower support band 31 which is provided with eyelets 32 in its extremities in which two separate belts 33 and 34 are attached or passed through respectively. In FIG. 11, the belt parts are formed as raising slings 35 and 36. The upper part of the transport strap is formed by a cover 37 or by a cover 38. When using cover 37, the belts are placed exactly as in the lower support band 31 and the belt slings 39 are led through the belt slings 33–36 and next the belt slings 39 are attached to e.g. a lifting device. Again, pulling the slings 39 results in the self-locking effect.

The cover 38 is provided with only two belts of which each forms a sling 40; a sling 39 is passed through the two lower slings of the support band 31 (at both sides) and then it is pulled upwards to lift the load and the intended tightening effect is immediately obtained.

FIG. 12 shows a transport strap with a solid lower part 61, constructed as a case, possibly provided with grooves 66 at the bottom for transport by a lifting machine. The upper part is made of a similarly formed solid part 62. Along its edges, the parts 61 and 62 are provided with holes 64 for an element 65 which forms a unit with hooks and with an eyelet. Two belts connect the eyelets 65 with the upper and lower parts 61–62 respectively. The transport strap is locked tightly around the object by means of raising sling 63.

I claim:

1. A self-locking transport strap, particularly adapted to carry a heavy or irregularly shaped object, said transport strap comprising: flexible support band means adapted to pass underneath and along opposite upwardly extending sides of an object which is to be supported, said support band means having a pair of ends, each of which ends includes at least two spaced openings; an endless belt adapted to pass over the top of an object which is to be supported and slidably guided in and connected respectively through said openings at each end of said support band means to provide two end loops interconnecting the ends of said band means and at least one intermediate loop at each end of said band means and extending outwardly from said band means between said openings; and carrying means connected to said intermediate loops for carrying an object which is to be supported, the endless belt being drawn tightly against the object to securely carry the object when a lifting force is applied to said carrying means.

2. A transport strap according to claim 1, wherein said support band means has an adjustable length to permit changing the spacing between the ends thereof.

3. A transport strap according to claim 1, wherein the support band means is made of a net-like construction and holes at its ends define the openings for the belt.

* * * * *